US005307949A

United States Patent [19]

Von Holdt, Jr.

[11] Patent Number: 5,307,949

[45] Date of Patent: May 3, 1994

[54] TEAR-AWAY LID AND CONTAINER

[76] Inventor: John W. Von Holdt, Jr., 6801 N. Loron, Chicago, Ill. 60646

[21] Appl. No.: 994,355

[22] Filed: Dec. 21, 1992

[51] Int. Cl.[5] ..... B65D 41/46

[52] U.S. Cl. ..... 220/276; 220/284; 220/307; 220/354

[58] Field of Search ..... 220/260, 265, 276, 284, 220/307, 267, 268, 277, 285, 354

[56] References Cited

U.S. PATENT DOCUMENTS

| | | | |
|---|---|---|---|
| 3,514,011 | 5/1970 | Madeira et al. | 220/284 |
| 3,791,551 | 2/1974 | Madeira | 220/284 X |
| 4,165,018 | 8/1979 | Giggard | 220/284 |
| 4,308,970 | 1/1982 | Von Holdt . | |
| 4,335,827 | 6/1982 | Knize et al. | 220/284 |
| 4,378,895 | 4/1983 | Woinarski | 220/306 |
| 4,380,305 | 4/1983 | Von Holdt . | |
| 4,420,093 | 12/1983 | Von Holdt . | |
| 4,452,382 | 6/1984 | Von Holdt . | |
| 4,512,493 | 4/1985 | Von Holdt . | |
| 4,512,494 | 4/1985 | Von Holdt . | |
| 4,574,974 | 3/1986 | Von Holdt . | |
| 4,667,843 | 5/1987 | Galer | 220/354 |
| 4,682,707 | 7/1987 | Wiles | 220/307 |
| 4,735,337 | 4/1988 | Von Holdt . | |
| 4,905,861 | 3/1990 | Boxall et al. | 220/266 |
| 5,125,530 | 6/1992 | Straub | 220/307 |

*Primary Examiner*—Allan N. Shoap
*Assistant Examiner*—Vanessa Caretto
*Attorney, Agent, or Firm*—Allegretti & Witcoff, Ltd.

[57] ABSTRACT

A plastic container lid is adapted for removable attachment to a container. The lid comprises spaced inner and outer peripheral walls defining between them a substantially annular sealing seat for a lid retaining ring carried by the container. The outer wall of the lid defines inwardly-positioned projection means to engage the retaining ring of the container, to facilitate retention of the lid on the container. The outer peripheral wall defines at least one circumferentially extending line of tearing weakness to permit separation of at least some of the inwardly positioned projection means from the remainder of the lid. The lid outer wall defines one or more apertures or recesses to provide access to a pry member, to allow prying of the lid away from its retention on a container while causing the line of weakness to tear, permitting removal of the lid and at least partial separation of the projection means from the lid.

26 Claims, 3 Drawing Sheets

FIG.1
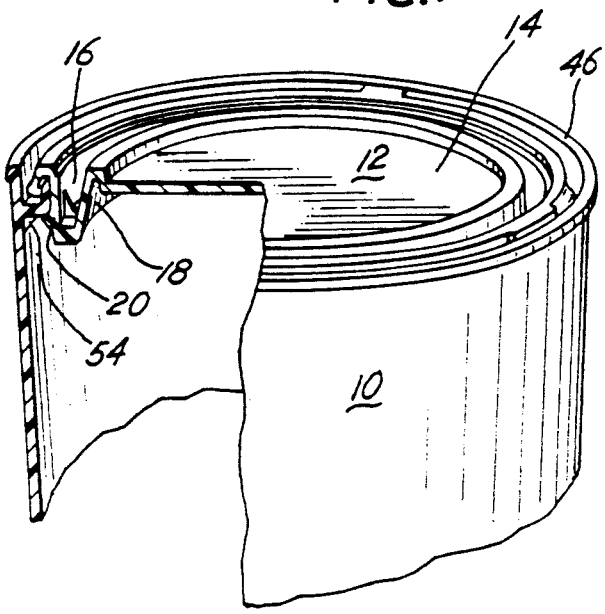
FIG.2
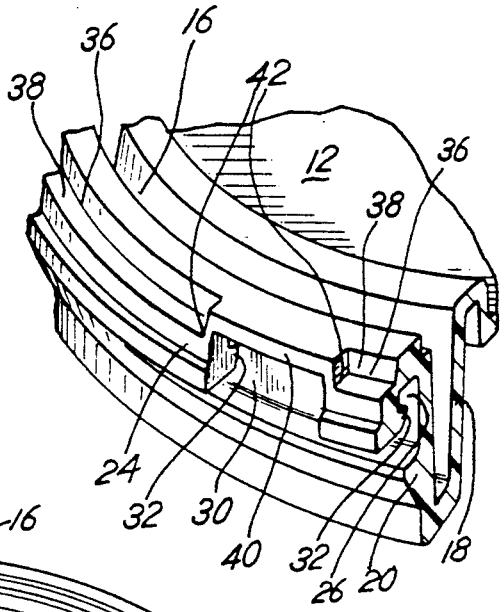
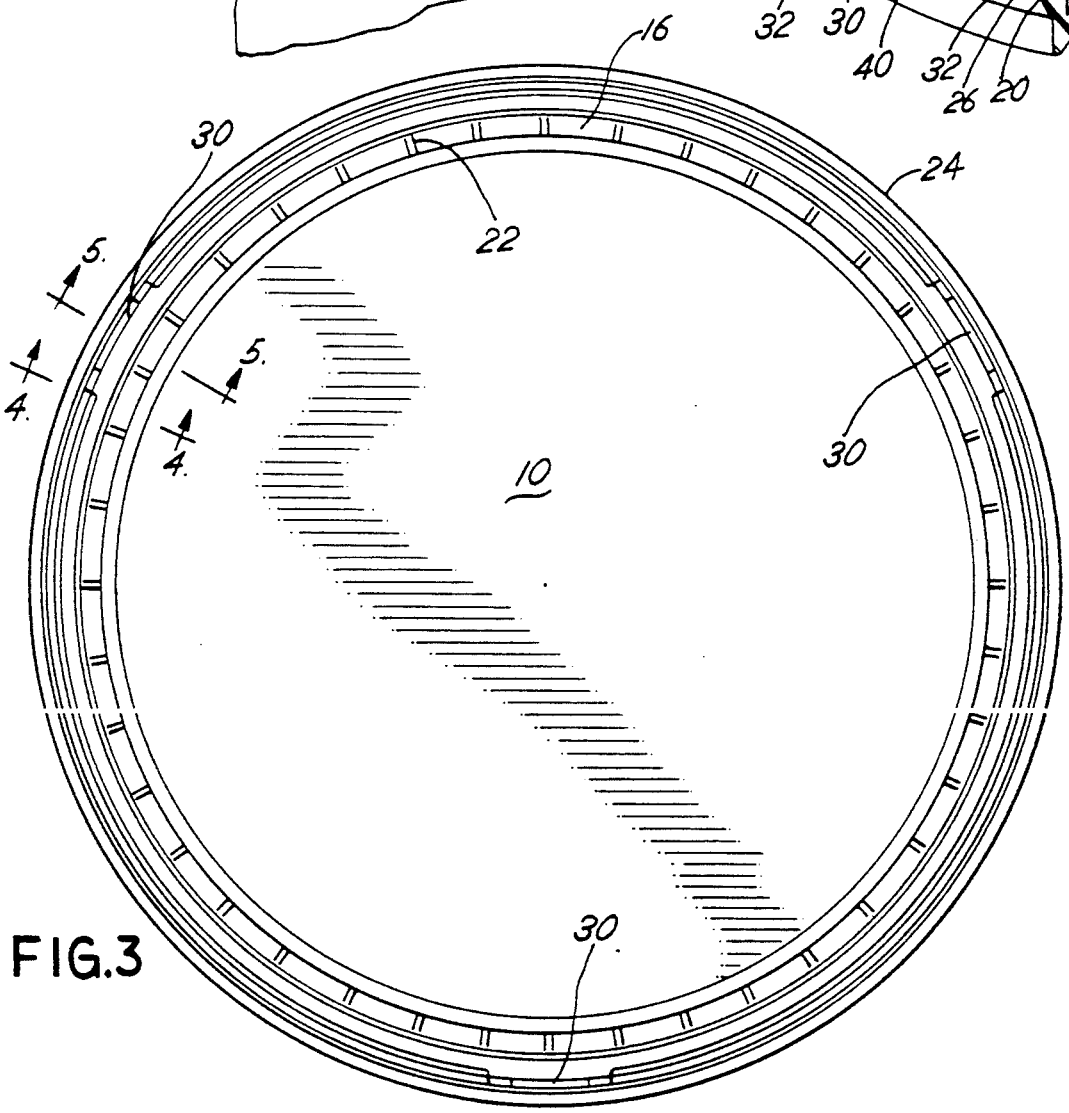
FIG.3

FIG.4
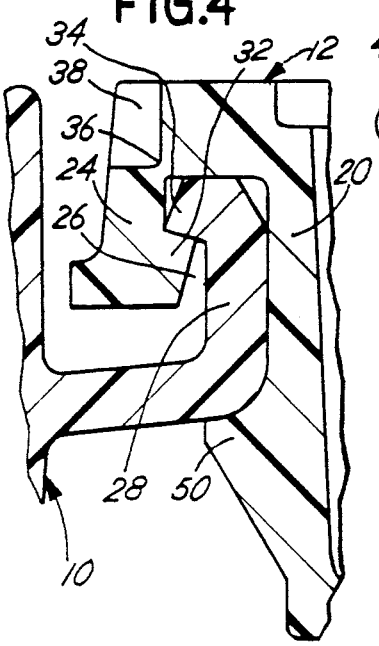
FIG.5
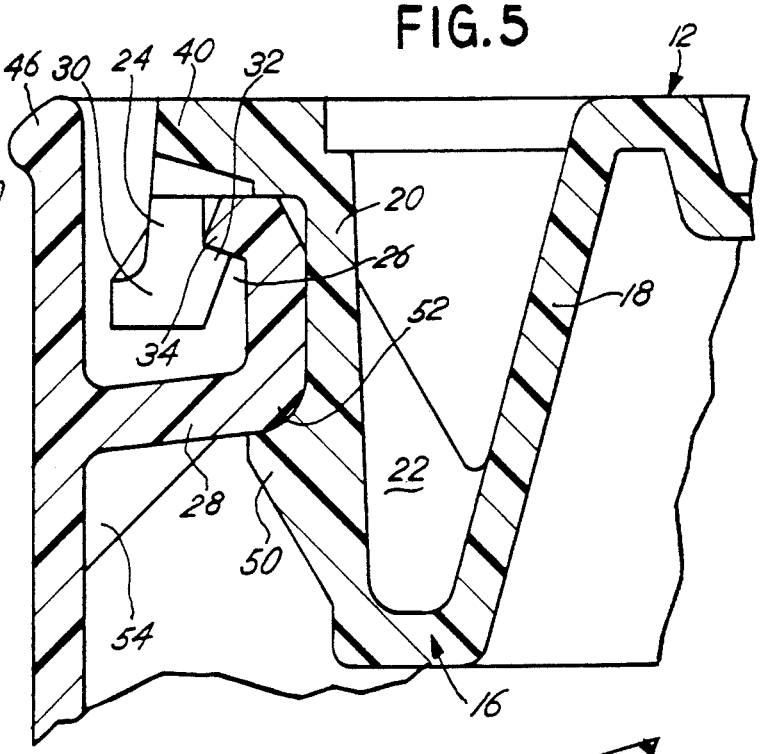
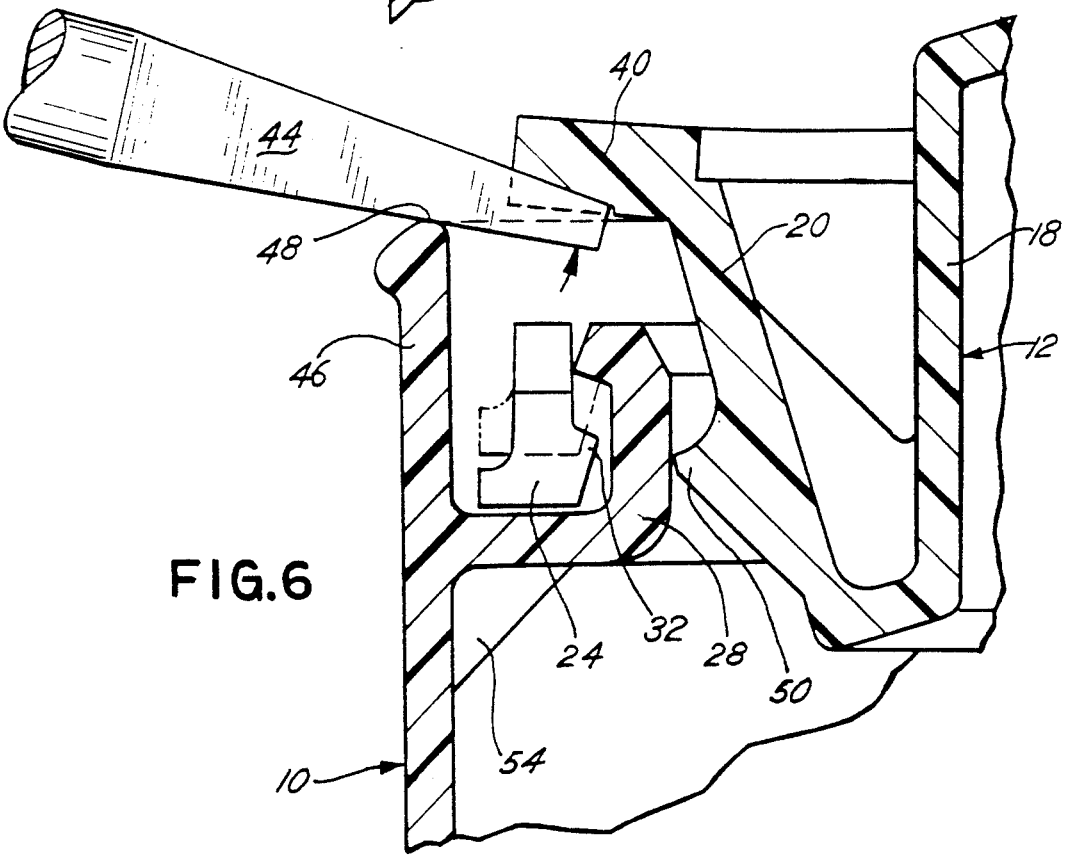
FIG.6

FIG.7
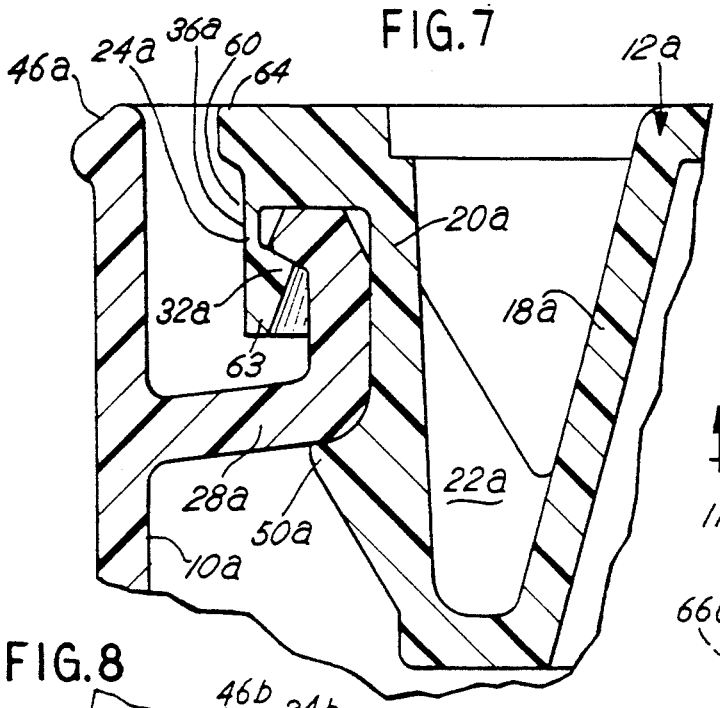
FIG.10
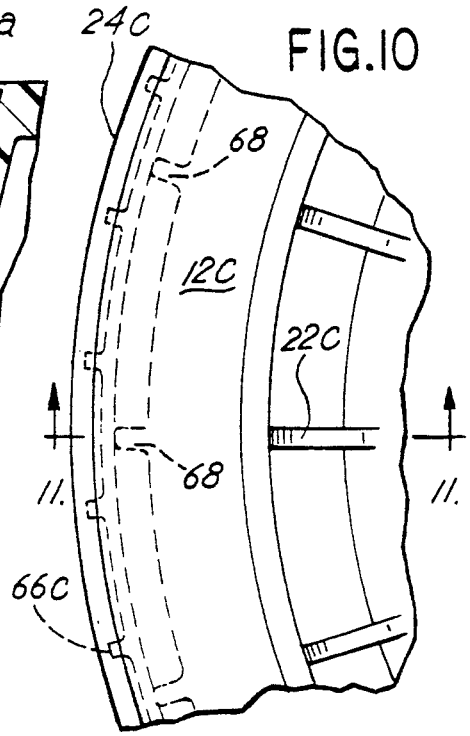
FIG.8
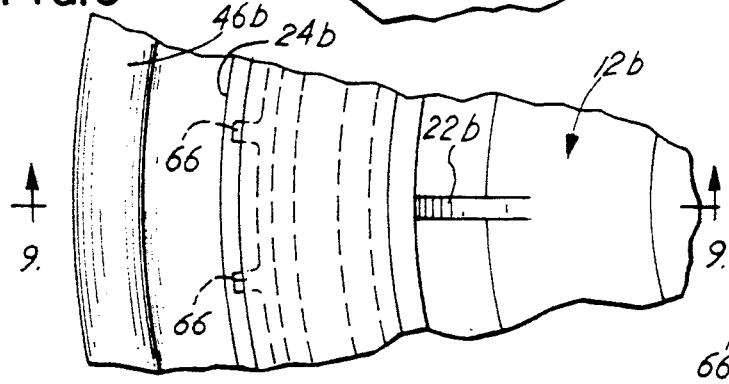
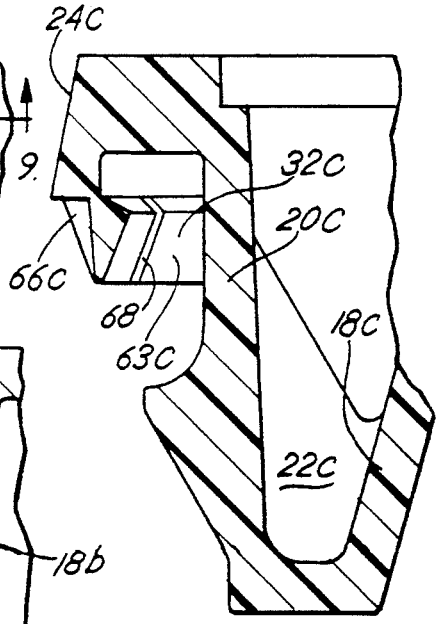
FIG.11
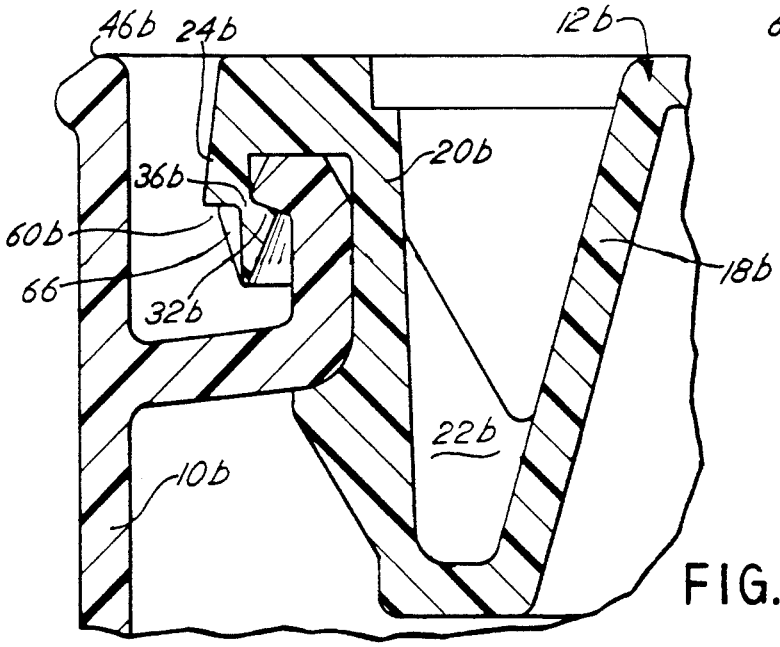
FIG.9

TEAR-AWAY LID AND CONTAINER

BACKGROUND OF THE INVENTION

Von Holdt U.S. Pat. No. 4,210,258 discloses various designs of bucket lids, some of which have a tear-away characteristic. However, the ideal lid for containers has yet to become available to the industry, with such an ideal container and lid exhibiting the advantages described in the above cited patent of excellent drop-retention characteristics, coupled with improved hoop strength, and an improved tear-away, tamper evident seal which, nevertheless permits the lid to be sealingly reclosed in the bucket.

DESCRIPTION OF THE INVENTION

By this invention a plastic container lid is provided, being adapted for removable attachment adjacent its periphery to a container. The lid comprises spaced inner and outer peripheral walls defining between them a substantially annular sealing seat for a lid retaining ring carried by the container. The outer, peripheral wall of the lid defines inwardly-positioned projection means to engage the retaining ring of the container, to facilitate sealed retention of the lid on the container.

The outer peripheral wall also defines at least one circumferentially extending line of tearing weakness, to permit separation of at least some of the inwardly-positioned projection means, and preferably all of it, from the remainder of the lid.

By this invention, the lid outer wall defines aperture means to provide access to a pry member such as a screw driver. The pry member is used to pry the lid away from its retention on a container, while causing the circumferential line of weakness to tear. This permits removal of the lid and at least partial separation of the projection means from the lid. Typically the projection means, which is close to annular in its extent, is completely separated from the lid.

The inner peripheral wall of the container lid defines an annular, outwardly projecting member to sealingly engage the lid retaining ring of a container upon which the lid is carried. Thus, even after the inwardly positioned projection means of the lid has been removed by tearing of the line of weakness, the container lid can still be used to reclose the container in sealing manner.

Preferably, the aperture means of the outer peripheral wall of the lid is defined below a reinforced portion of the outer, peripheral wall, to withstand action of the pry member and thus to facilitate tearing of the line of weakness. In this circumstance, the circumferentially extending line of tearing weakness may also extend radially outwardly adjacent both ends of the reinforced portion, to permit separation of the reinforced portion from the inwardly-positioned projection means by action of the pry member. Thus, the reinforced portion remains with the lid as the line of weakness is torn, while the inwardly-positioned projection means is torn away. In one preferred design, the inwardly-positioned projection means of the lid is interrupted at the aperture means so that a screw driver or other pry member is inserted through the aperture means to a position that is circumferentially between portions of the inwardly-positioned projection means.

When the container lid is attached to a container such as a bucket, with the retaining ring of the container occupying the annular sealing seat of the lid, it is preferred for the container to have an outer rim surrounding the lid, to provide a fulcrum for the pry member in its action of breaking the line of tearing weakness for removal of the lid the first time.

By this invention there can be added to the container lid of the prior art significantly improved hoop strength for the container and lid system, coupled with an easily openable, tear-away, tamper evident characteristic which, nevertheless, allows resealing of the container as is of course highly desirable in most situations.

Additionally, the lid of this invention may be used on metal or plastic paint cans or the like, with a desirable, double lip design of the can contributing to the improved hoop strength. Thus, the outer rim of the can surrounding the lid is useful (1) because it provides the fulcrum discussed above, (2) because it provides good hoop strength, and (3) because a commercial design of can may be utilized with the novel lid of this invention in presently available paint filling lines and the like, because of the use of conventional dimensions.

DESCRIPTION OF THE DRAWINGS

In the drawings, FIG. 1 is a perspective view, with a portion broken away, of the container and plastic lid of this invention;

FIG. 2 is an enlarged, fragmentary perspective view of a portion of the container lid;

FIG. 3 is an enlarged, plan view of the lid of this invention;

FIG. 4 is an enlarged, sectional view taken along line 4—4 of FIG. 3 with the lid carried on a container;

FIG. 5 is an enlarged, sectional view taken along line 5—5 of FIG. 3 with the lid carried on a container;

FIG. 6 is a sectional view similar to FIG. 5 showing how a pry member such as a screw driver can remove the lid of this invention from the container upon which it is carried;

FIG. 7 is an enlarged, sectional view similar to FIG. 5 of another embodiment of lid of this invention, carried on a container;

FIG. 8 is an enlarged, fragmentary plan view of a further embodiment of a lid of this invention;

FIG. 9 is a sectional view taken along line 9—9 of FIG. 8;

FIG. 10 is an enlarged, fragmentary plan view of a modification of the embodiment of FIGS. 8-9; and FIG. 11 is a sectional view taken along line 11—11 of FIG. 10.

DESCRIPTION OF SPECIFIC EMBODIMENTS

Referring to the drawings, a container 10, which may be a steel or plastic paint can, carries a plastic lid 12 in accordance with this invention. Lid 12 may be made of a single, molded, plastic piece, comprising a central, flat portion 14, which is surrounded by a convoluted section 16 to provide resilience and flexibility to lid 12, which contributes to the drop resistance of the lid and container without the lid separating from container 10. Convolution 16 is defined by innermost wall 18, which is positioned transversely to the plane of lid central portion 14. The outer portion of convolution 16 is defined by inner peripheral wall 20. As shown in FIG. 5 particularly, convolution 16, defined by innermost wall 18 and inner peripheral wall 20, in turn has vanes 22 extending between the two walls 18, 20 as shown, to increase the stiffness of the convolution 16 without causing the system to become completely rigid, so that a controlled flexibility of the outer portion of lid 12 is provided, dependent upon the shape and number of vanes 22.

Lid 10 also defines an outer peripheral wall 24 which, with inner peripheral wall 20, defines a substantially annular sealing seat 26 for receiving lid retaining ring 28 of the bucket.

Outer peripheral wall 24, in turn, defines an inwardly positioned projection 32, which is typically of practically annular extent except for interruptions provided by apertures 30, three of which are provided in this embodiment, extending through outer peripheral wall 24 to interrupt the lower part of outer wall 24 and inwardly positioned projection means 32. See FIG. 2.

Inward projection 32 is positioned to engage an annular, outwardly extending projection 34 of bucket retaining ring 28, to cause interlocking, sealing retention of lid 12 on bucket 10, as particularly shown in FIGS. 4 and 5.

Outer peripheral wall 24 carries a circumferentially extending line of tearing weakness 36, which extends about most of the periphery of outer wall 24, within indentation 38, as illustrated in FIGS. 2 and 4. Indentation 38, however, is interrupted in the vicinity of each aperture 30 by the presence of reinforced portion 40 of outer wall 24, which overlies aperture 30, as particularly shown in FIGS. 2 and 5.

Circumferential line of tearing weakness 36 defines a radial extension line of tearing weakness 42 at each side of each reinforced portion 40 so that, as a pry member such as a screw driver 44 is inserted into aperture 30 and reinforced member 40 is pried upwardly, radially extending line of weakness sections 42 may be ruptured, followed by rupture of the circumferential line of weakness portions 36, to cause separation of the lower portion of outer wall 24 carrying inward projection portions 32 from the reinforced portion 40 and the remainder of lid 12. This process is illustrated in FIG. 6.

Specifically, container or bucket 10 as used in this invention preferably carries not only an inwardly projecting, lid-retaining ring 28, but also an annular outer rim 46 which surrounds lid 12 in spaced relation and which provides a fulcrum 48 for pry member 44, to permit the upward prying of reinforced portion 40 and the tearing of line of weakness 36, 42.

Lid 12 also defines, on inner peripheral wall 20, an annular, outwardly projecting member 50 which sealingly engages the lid retaining ring 28 of bucket 10 when the lid is in sealed relation. Thus, removal of the lower portion of outer wall 24 by pry member 44 does not eliminate the sealing potential of lid 12 when mounted on bucket 10, a sealing function being provided by member 50 abutting against an annular corner 52 of retaining ring 28. Thus, even after opening as shown in FIG. 6, lid 12 may be once again replaced into sealing relation with bucket 10, being readily reopenable by the action of pry member 44 in the manner shown.

If desired, annular sealing seat 26 of bucket 10 may be reinforced with vanes or fins 54 which extend radially as shown, for desired stiffening and reinforcement of lid retaining ring 28.

FIG. 7 shows a modified embodiment of the lid of this invention, shown to be carried on the annular rim of a container in a manner similar to that previously described. However, in this embodiment, outer peripheral wall **24*a* of lid 12*a* comprises a complete, uninterrupted ring which is free of apertures similar to apertures 30 as in the previous embodiment. Instead, outer peripheral wall 24*a* defines typically an annular recess 60, or otherwise a plurality of circumferentially spaced recesses, which recess or recesses are spaced from the top 64 of outer peripheral wall 24*a***.

Thus the top 64 of recess 60 defines a site which may be engaged by a prying tool similar to screw driver 44, while the screw driver rests against the top of annular outer rim **46*a* of the bucket or other container 10*a* to which lid 12*a* is attached in a manner which is similar to that of the previous embodiment, except as otherwise indicated herein. Under the influence of such prying action, annular line of weakness 36*a* can be severed, causing separation of the bottom portion 63 of outer peripheral wall 24*a*, which bottom portion includes annular, inwardly extending projection 32*a*, which locks the lid onto the container and provides an annular seal. Thus, projection 32*a* can be separated by such prying, facilitating removal of the lid. As in the previous embodiment, annular, outwardly projecting member 50*a* engages the lid retaining ring 28*a* of container 10*a* to provide an added annular seal, having a strength which is in part governed by the nature, distribution and number of vanes 22*a* carried between inner peripheral wall 20*a* and innermost wall 18*a*** of the lid.

An advantage of the above embodiment is that, until opening, a double hermetic seal is provided, one seal being provided at annular, outwardly projecting member **50*a*, and another seal being provided at annular, inwardly positioned projection means 32*a***. This can improve the shelf life of paints and other materials, especially when subjected to tropical conditions, until the container is opened.

Turning to FIGS. 8 and 9, another embodiment of a plastic lid **12*b* and container 10*b*** in accordance with this invention is disclosed, being similar to the previous embodiments except as otherwise indicated herein.

In this particular embodiment, outer lid wall **24*b* comprises a circumferential recess 60*b* which is annular, except for the interruption of circumferentially spaced, radially extending ribs 66 for stiffening outer peripheral wall 24*b*. Ribs 66 are preferably spaced to permit a screw driver to engage the top of recess 60*b* and to bear against the top 46*b* of container 10*b*, for breaking open of outer wall 24*b* of the lid by rupturing of circumferential line of weakness 36*b***.

The remainder of lid **12*b* may be similar to previous embodiments, comprising annular, inner wall 20*b* and innermost wall 18*b*, with the two walls being connected by ribs 22*b*** as in the previous embodiments.

FIGS. 10 and 11 disclose an embodiment that is similar to the embodiments of FIGS. 8 and 9 except that the lower portion **63*c* of outer peripheral wall 24*c* (which is otherwise similar to the corresponding parts of the previous embodiments), defines an annular, inwardly positioned projection 32*c* that has one or more slots 68 to reduce the holding strength of projection 32*c***.

Apart from that, the embodiment may be identical to that of FIGS. 8 and 9, having ribs **66*c*, an annular inner wall 20*c*, and annular outer wall 24*c*, with connecting radial ribs 22*c***.

Thus, by the desired positioning of slot or slots 68 and ribs **66*c*, if any, the opening and handling characteristics of the lid of this invention may be adjusted to any desired performance characteristics. The presence or absence of radial ribs 22*c*** may also be part of this designing to adjust the desired performance characteristics of the lid of this invention.

Thus a plastic lid is provided in accordance with this invention which may be carried on a container of commercial design, to provide a lid and bucket system having excellent drop resistant characteristics, coupled with high hoop strength even in the situation where the bucket is made of plastic, and exhibiting a tear-away, tamper evident, initial seal coupled with good resealing characteristics for continued, reliable storage of the container contents after opening.

The above has been offered for illustrative purposes only, and is not intended to limit the scope of the invention of this application, which is as defined in the claims below:

That which is claimed is:

1. A plastic lid having a periphery for removable attachment adjacent its periphery to a container, said lid comprising spaced inner and outer peripheral walls defining between them a substantially annular sealing seat for a lid retaining ring carried by the container, said outer, peripheral wall of the lid defining inwardly-positioned projection means to engage said retaining ring of the container to facilitate retention of the lid on said container; said outer, peripheral wall defining at least one circumferentially extending line of tearing weakness to permit separation of at least some of said inwardly-positioned projection means from the remainder of said lid, said lid outer peripheral wall defining at least one aperture or recess to provide access for pry member, to allow prying of said lid away from its retention on a bucket while causing said line of weakness to tear, permitting removal of said lid and at least partial separation of said projection means from the lid.

2. The container lid of claim 1 in which said inner peripheral wall defines an annular, outwardly projecting member to sealingly engage the lid retaining ring of a container upon which said lid is carried.

3. The container lid of claim 1 in which said aperture or recess is defined below a reinforced portion of said outer, peripheral wall proportioned to withstand action of said pry member.

4. The container lid of claim 3 in which said circumferentially extending line of tearing weakness also extends radially outwardly adjacent said reinforced portion to permit separation of said reinforced portion from the lid projection means by said pry member.

5. The container lid of claim 1 in which said inwardly-positioned projection means is interrupted at said aperture or recess.

6. The container lid of claim 1 in which a plurality of said apertures or recesses are present.

7. The container lid of claim 1 which is attached to a container, with the container having a lid retaining ring occupying the annular sealing seat, said container having an outer rim surrounding said lid, spaced from said lid, and positioned to provide a fulcrum for said pry member.

8. The container lid of claim 7 in which said aperture or recess comprises a circumferentially extending recess defined in said outer, peripheral wall, to allow said prying of said lid.

9. The container lid of claim 8 in which said circumferentially extending recess is annular.

10. The container lid of claim 8 in which said circumferential recess carries spaced radially extending ribs for stiffening said outer, peripheral wall.

11. The container lid of claim 1 in which said aperture or recess comprises a circumferentially extending recess defined in said outer, peripheral wall, to allow said prying of said lid.

12. A plastic lid having a periphery which is removably attached to a container by an attachment area adjacent the periphery of said lid, said lid comprising spaced, inner and outer peripheral walls defining between them a substantially annular sealing seat; a lid retaining ring carried by the container, a portion of said retaining ring projecting into said sealing seat; the outer wall of the lid defining inwardly-positioned projection means to engage said retaining ring of the container to facilitate retention of the lid on said container; said outer peripheral wall defining at least one circumferentially extending line of tearing weakness to permit separation of at least some of said inwardly positioned projection means from the remainder of said lid, said lid outer wall defining at least one aperture or recess to provide access to a pry member, to allow prying of said lid away from its retention on a container while causing said line of weakness to tear, permitting removal of said lid and at least partial separation of said projection means from the lid; said container having an outer rim surrounding said lid in spaced relation to provide a fulcrum for said pry member, said inner, peripheral wall of the lid defining an annular, outwardly projecting member to sealingly engage the lid retaining ring of said container.

13. The container lid of claim 12 in which said aperture or recess is defined below a reinforced portion of said outer peripheral wall to withstand action of said pry member.

14. The container lid of claim 13 in which said circumferentially extending line of tearing weakness also extends radially outwardly adjacent said reinforced portion to permit separation of said reinforced portion from the lid projection means by line-tearing action of said pry member.

15. The container lid of claim 14 in which said inwardly-positioned projection means of said lid is interrupted at said aperture or recess.

16. The container lid of claim 15 in which a plurality of said apertures are present, with a reinforced portion of said outer peripheral wall being defined over each of said apertures.

17. The container lid of claim 16 in which said lid defines an annular convolution positioned inside of said inner peripheral wall, to facilitate flexing of said lid.

18. The container lid of claim 17 in which radially extending fins occupy at least a portion of space within said convolution to provide a controlled flex-strengthening thereof.

19. A plastic lid having a periphery for removable attachment adjacent its periphery to a container, said lid comprising spaced inner and outer peripheral walls defining between then a substantially annular sealing seat for a lid retaining ring carried by the container, said outer peripheral wall of the lid defining inwardly-positioned projection means to engage the retaining ring of the container to facilitate retention of the lid on said container; said outer peripheral wall defining at least one circumferentially extending line of tearing weakness to permit separation of at least some of said inwardly-positioned projection means from the remainder of said lid, said lid outer peripheral wall defining a plurality of spaced apertures to provide access to a pry member, to allow prying of said lid away from its retention on a container while causing said line of weakness to tear, permitting removal of said lid and at least partial separation of said projection means from the lid, said inner peripheral wall defining an annular, outwardly projecting member to sealingly engage the lid retaining ring of a container upon which said lid is carried, each of said apertures being defined below a reinforced portion of the outer peripheral wall proportioned to withstand action of said pry member.

20. The container lid of claim 19 in which said circumferentially extending line of tearing weakness also extends radially outwardly adjacent said reinforced portions to permit separation of said reinforced portions from the lid projection means by said pry member.

21. The container lid of claim 20 in which said inwardly-positioned projection means is interrupted at each of said plurality of said apertures.

22. The container lid of claim 21 in which said lid defines an annular convolution positioned inside of said inner peripheral wall, to facilitate flexing of said lid, in which radially extending fins occupy at least a portion of space within said convolution to provide a controlled flex-strengthening thereof.

23. A plastic lid having a periphery which is removably attached to a container by an attachment area adjacent the periphery of said lid, said lid comprising spaced, inner and outer peripheral walls defining between them a substantially annular sealing seat; a lid retaining ring carried by the container, said retaining ring projecting into said sealing seat; the outer peripheral wall of the lid defining annular inwardly-positioned projection means to sealingly engage the retaining ring of the container to facilitate retention of the lid on said container; said outer peripheral wall having a top and defining at least one circumferentially extending line of tearing weakness to permit separation of at least some of said inwardly positioned projection means from the remainder of said lid, said lid outer peripheral wall defining a circumferentially extending recess space from the top of said outer, peripheral wall of the lid to provide access to a pry member, to allow prying of said lid away from its retention on a container while causing said line of weakness to tear, permitting removal of said lid and at least partial separation of said projection means from the lid; said container having an outer rim surrounding said lid in spaced relation to said lid to provide a fulcrum for said pry member.

24. The container lid of claim 23 in which said circumferentially extending recess is annular.

25. The container lid of claim 23 in which said circumferentially extending recess carries spaced, radially extending ribs for stiffening said outer, peripheral wall.

26. The container lid of claim 23 in which said inner peripheral wall defines an annular, outwardly projecting member to sealingly engage the lid retaining ring of a container upon which said lid is carried, whereby a double, annular seal is provided between the lid and the container: a first seal between said outer peripheral wall and the lid retaining ring and a second seal at said annular, outwardly projecting member and said lid retaining ring.

* * * * *